US011030989B2

(12) United States Patent
Thormundsson et al.

(10) Patent No.: US 11,030,989 B2
(45) Date of Patent: Jun. 8, 2021

(54) METHODS AND SYSTEMS FOR END-USER TUNING OF AN ACTIVE NOISE CANCELLING AUDIO DEVICE

(71) Applicant: SYNAPTICS INCORPORATED, San Jose, CA (US)

(72) Inventors: Trausti Thormundsson, Irvine, CA (US); Govind Kannan, Irvine, CA (US); Ali Abdollahzadeh Milani, San Francisco, CA (US); Ragnar Hlynur Jonsson, Laguna Niguel, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 15/853,645

(22) Filed: Dec. 22, 2017

(65) Prior Publication Data

US 2018/0182371 A1 Jun. 28, 2018

Related U.S. Application Data

(60) Provisional application No. 62/438,450, filed on Dec. 22, 2016.

(51) Int. Cl.
*G10K 11/178* (2006.01)
*H04R 1/10* (2006.01)

(52) U.S. Cl.
CPC .... *G10K 11/17853* (2018.01); *G10K 11/1787* (2018.01); *G10K 11/17815* (2018.01); *G10K 11/17833* (2018.01); *G10K 11/17881* (2018.01); *H04R 1/1083* (2013.01); *G10K 2210/1081* (2013.01); *G10K 2210/3016* (2013.01); *G10K 2210/3026* (2013.01); *G10K 2210/3027* (2013.01); *G10K 2210/3028* (2013.01); *G10K 2210/3035* (2013.01); *G10K 2210/3047* (2013.01); *G10K 2210/504* (2013.01); *H04R 2460/01* (2013.01)

(58) Field of Classification Search
None
See application file for complete search history.

(56) References Cited

U.S. PATENT DOCUMENTS 8,406,430 B2 3/2013 Beaugeant et al.
9,094,744 B1 7/2015 Lu et al.
(Continued)

FOREIGN PATENT DOCUMENTS

CN 104661151 5/2015
KR 10-2009-0115450 11/2009

*Primary Examiner* — James K Mooney
(74) *Attorney, Agent, or Firm* — Haynes and Boone, LLP

(57) ABSTRACT

An active noise cancellation system includes a sensor operable to sense environmental noise and generate a corresponding reference signal, a fixed noise cancellation filter including a predetermined model of the active noise cancellation system operable to generate an anti-noise signal, and a tunable noise cancellation filter operable to modify the anti-noise signal in accordance with stored coefficients, wherein the tunable noise cancellation filter is further operable to modify the stored coefficients in real-time based on user feedback and generate a tuned anti-noise signal that models tunable deviations from the predetermined noise model. A graphical user interface is operable to receive user adjustments of tunable parameters in real-time, the tunable parameters corresponding to at least one of the stored coefficients.

20 Claims, 6 Drawing Sheets

(56) References Cited

U.S. PATENT DOCUMENTS

| | | | | |
|---|---|---|---|---|
| 9,640,168 | B2 | 5/2017 | Nooralahiyan et al. | |
| 2004/0264706 | A1 | 12/2004 | Ray et al. | |
| 2009/0046868 | A1* | 2/2009 | Engle | H04R 1/1041 381/74 |
| 2014/0044275 | A1* | 2/2014 | Goldstein | H04R 1/1083 381/71.6 |
| 2014/0314245 | A1* | 10/2014 | Asada | H04R 1/1083 381/71.6 |
| 2015/0154950 | A1 | 6/2015 | Ring | |
| 2016/0125869 | A1* | 5/2016 | Kulavik | G10K 11/178 381/71.6 |
| 2016/0161588 | A1 | 6/2016 | Benattar | |
| 2016/0163303 | A1* | 6/2016 | Benattar | G10K 11/175 381/71.11 |
| 2016/0316297 | A1 | 10/2016 | Yang et al. | |
| 2017/0053639 | A1* | 2/2017 | Lu | G10K 11/178 |

* cited by examiner

METHODS AND SYSTEMS FOR END-USER TUNING OF AN ACTIVE NOISE CANCELLING AUDIO DEVICE

CROSS-REFERENCE TO RELATED APPLICATIONS

This application claims the benefit of and priority to U.S. Provisional Patent Application No. 62/438,450 filed Dec. 22, 2016 and entitled "METHODS AND SYSTEMS FOR END-USER TUNING OF AN ACTIVE NOISE CANCELLING AUDIO DEVICE" which is incorporated herein by reference in its entirety.

TECHNICAL FIELD

The present application relates generally to audio processing, and more specifically to normalization and calibration of active noise cancelling audio devices, such as headphones.

BACKGROUND

Active noise cancellation (ANC) is a noise reduction technique in which an anti-noise signal (e.g., a signal equal in magnitude but opposite in phase to the noise) is generated through loudspeakers and directed towards a point where noise cancellation is desired, such as a human ear. The noise and anti-noise signal cancel each other acoustically. To achieve this effect, a low-latency, programmable filter path from a microphone to a loud-speaker is typically implemented to generate the anti-noise signal.

The availability of portable power in the form of mobile devices and advances in semiconductors has promoted application of ANC in audio devices, such as headphone platforms. One obstacle in deploying high performance ANC is the calibration which may be needed, such as by adjusting each unit in the manufacturing assembly line. The time and resources needed for such calibration may depend on the ANC implementation, the ANC technique, choice of components, and acoustic design of the device and often contributes to raise the cost of high performance ANC audio devices. The high cost to produce high performance ANC audio devices is one of the impediments to the widespread adoption of ANC.

There is therefore a continued need for improved systems and methods for providing cost efficient active noise cancellation audio devices, such as headphones.

SUMMARY

Systems and methods are disclosed for providing active noise cancellation in audio devices. In one embodiment, an active noise cancellation system comprises a sensor operable to sense environmental noise and generate a corresponding reference signal, a fixed noise cancellation filter including a predetermined model of the active noise cancellation system operable to generate an anti-noise signal, and a tunable noise cancellation filter operable to modify the anti-noise signal in accordance with stored coefficients, wherein the tunable noise cancellation filter is further operable to modify the stored coefficients in real-time based on user feedback and generate a tuned anti-noise signal that models tunable deviations from the predetermined noise model.

In various embodiments, a graphical user interface operable to receive user adjustments of tunable parameters in real-time that correspond to at least one of the stored coefficients. A loudspeaker is provided to receive the anti-noise signal and generate anti-noise to cancel the noise in a cancellation zone. In various embodiments, the active noise cancellation system may be implemented in a headphone, earbud or other active noise cancellation device. A host device communicably coupled to the tunable noise cancellation filter is operable to receive user adjustments to the stored coefficients and send adjusted coefficients to the tunable noise cancellation filter. Various embodiments may be implemented using a digital signal processor. In one embodiment, the tunable noise cancellation filter further comprises programmable firmware, and the host device comprises a firmware interface operable to adjust the stored coefficients in real time by modifying the programmable firmware through the firmware interface.

In various embodiments, a noise cancellation method includes receiving a reference signal from an external sensor, the reference signal representing external noise, processing the reference signal through a fixed noise cancellation filter to generate an anti-noise signal, processing the anti-noise signal through a tunable noise cancellation filter to generate a tuned anti-noise signal, outputting the tuned anti-noise signal to a loudspeaker, and adjusting coefficients of the tunable noise cancellation filter in real-time in response to perceived external noise in a noise cancellation zone. In one embodiment, the external microphone, the tunable noise cancellation filter, the fixed noise cancellation filter and the loudspeaker are embodied in a headphone.

In one embodiment, the fixed noise cancellation filter comprises a predetermined model of the headphone for generating the anti-noise signal to cancel external noise in the noise cancellation zone. The noise cancellation zone may be a location of a user's ear with reference to the loudspeaker. The tunable noise cancellation filter may model potential deviations from the predetermined model. In one embodiment, the coefficients are adjusted by adjusting custom parameters through a graphical user interface in response to the tuned anti-noise signal, and modifying firmware associated with the tunable noise cancellation filter to adjust the coefficient in accordance with user input.

In one embodiment, an active noise cancellation device comprises a sensor operable to sense environmental noise and generate a corresponding analog reference signal, an analog to digital converter operable to convert the analog reference signal to a digital reference signal, a fixed noise cancellation filter including a predetermined model of the active noise cancellation system operable to receive the digital reference signal and generate an anti-noise signal, and a tunable noise cancellation filter operable to modify the anti-noise signal in accordance with stored coefficients, wherein the tunable noise cancellation filter is further operable to modify the stored coefficients in real-time based on user feedback and generate a tuned anti-noise signal that models tunable deviations from the predetermined noise model.

The active noise cancellation device may further comprise an audio input operable to receive a desired audio signal and an adder operable to combine the desired audio signal and the tuned anti-noise signal to generate an output signal, and a loudspeaker operable to receive the output signal and output the output signal to the noise cancellation zone. A graphical user interface is provided to receive user adjustments of tunable parameters in real-time, the tunable parameters corresponding to at least one of the stored coefficients. In various embodiments, the active noise cancellation device may include a headphone, earbud, or other active noise cancelling device.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

In accordance with various embodiments of the present disclosure, systems and methods for tuning active noise cancellation in audio devices are provided. Controlling a noise field is an exceedingly difficult problem (e.g., due to the superposition principle) and the cancellation performance can fluctuate significantly from unit to unit. The variation can be due to multiple factors including transducer characteristics and variation in geometric fit. In various embodiments disclosed herein, an end-user can adjust or tune ANC performance based on his/her subjective judgment, thereby obviating the necessity of laborious and costly normalization and calibration steps on the production line.

Figure 1:
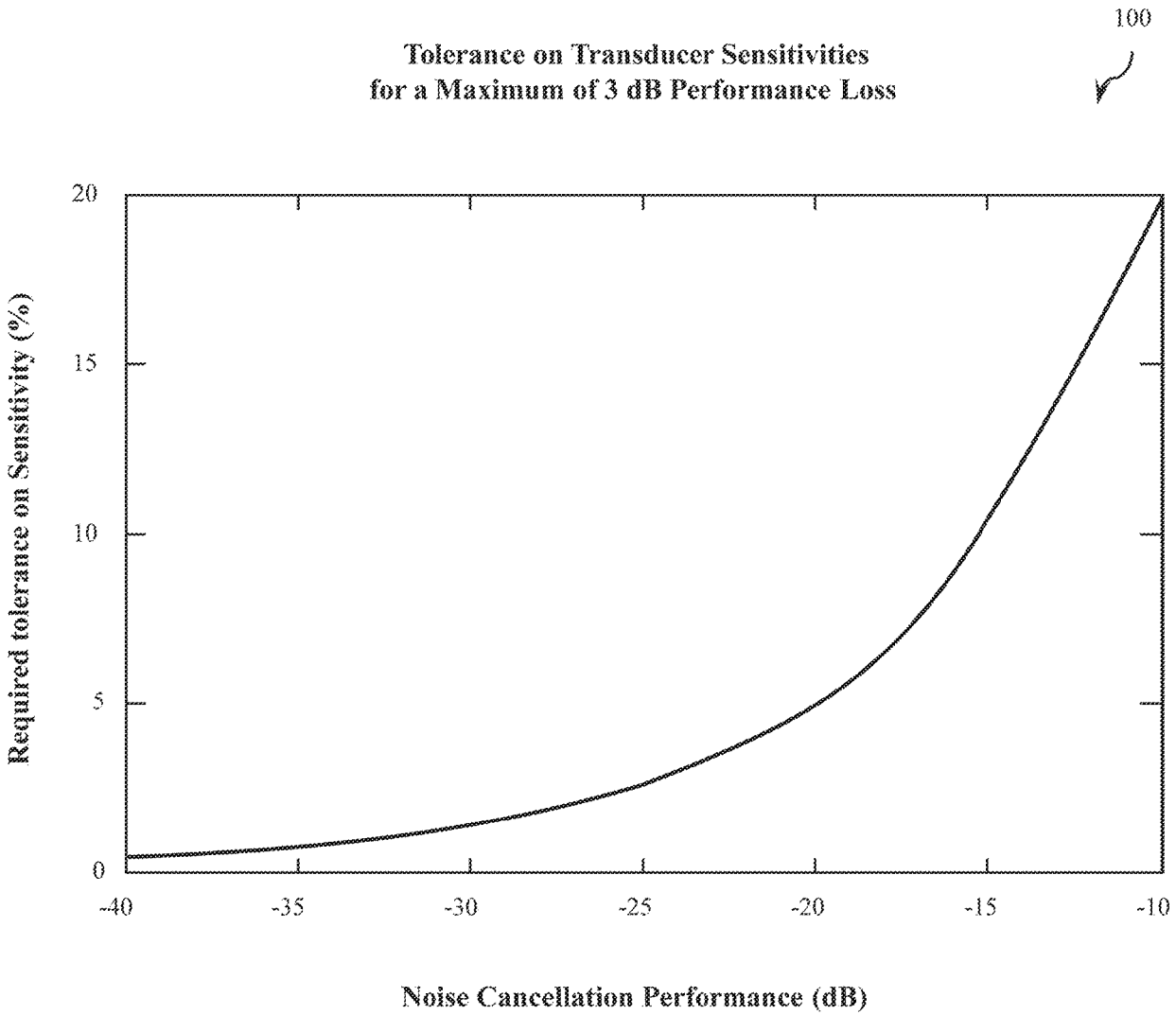
FIG. 1 is a graph illustrating a relationship between the tolerance of transducer sensitivities and noise cancellation performance in accordance with an embodiment of the present invention.

Referring to FIG. 1, a chart 100 illustrates a relationship between a required tolerance on transducer sensitivities and noise cancellation performance. As shown, the higher the noise cancellation needed at a certain frequency, the greater the effect on cancellation performance due to transducer sensitivity variations. Microphone and speaker driver sensitivities can vary from unit to unit, resulting in undesired variations in noise cancellation performance.

Figure 2:
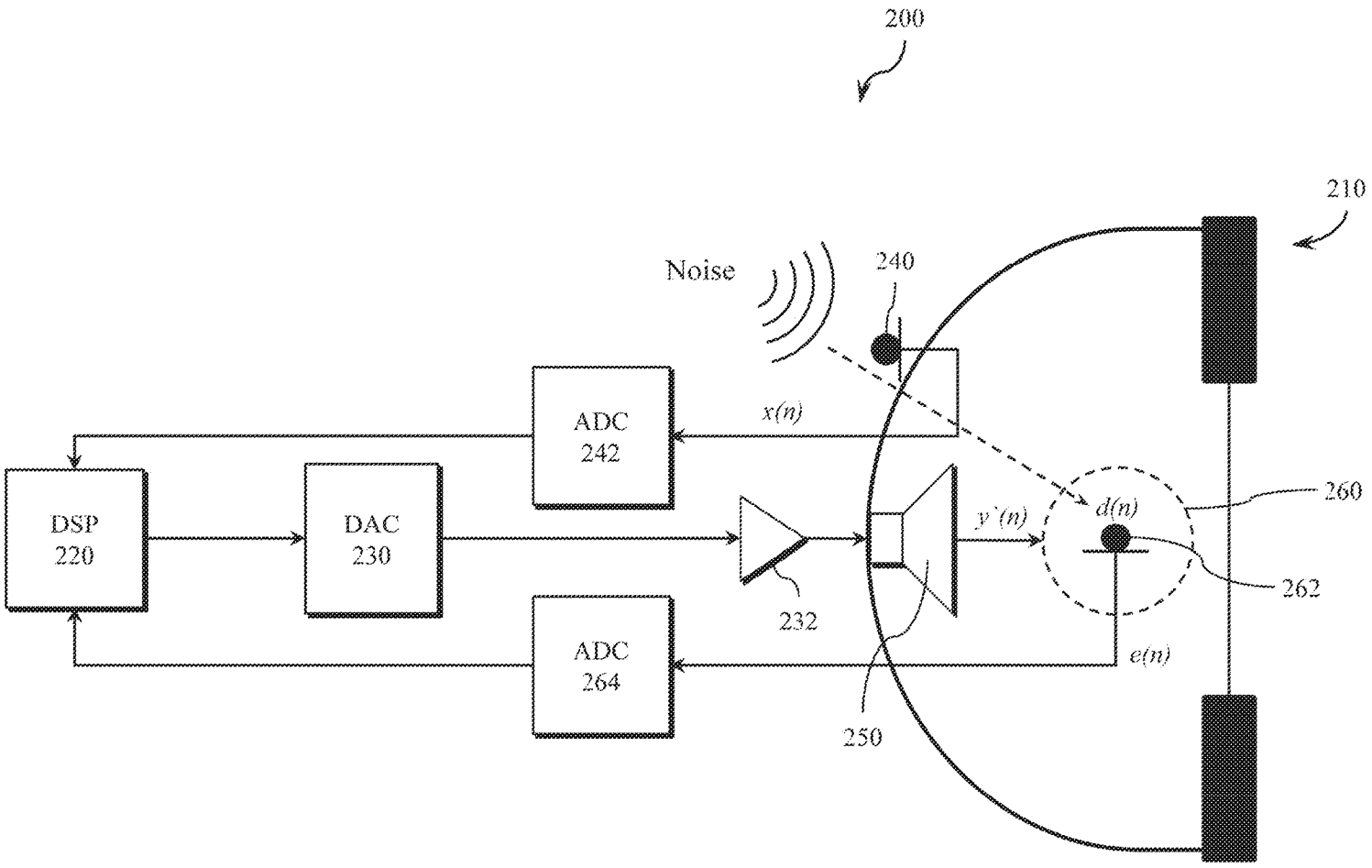
FIG. 2 illustrates a system for normalization and calibration of an active noise cancellation headset in accordance with an embodiment of the present invention.

Referring to FIG. 2, an embodiment of a system 200 for the realization of active noise cancellation in a headset will now be described. The system 200 includes an audio device, such as headphone 210, and processing circuitry including a digital signal processor (DSP) 220, a digital to analog converter (DAC) 230, an amplifier 232, a primary microphone 240, a loudspeaker 250, and an error microphone 262. In operation, a listener may hear external noise d(n) through the housing and components of the headphone 210, which may interfere with a desired audio signal (not shown) played through the loudspeaker 250. To cancel the noise d(n), the primary microphone 240 senses the external noise, producing a reference signal x(n) which is fed through analog to digital converter (ADC) 242 to DSP 220. DSP 220 generates an anti-noise signal which is fed through DAC 230 and amplifier 232 to loudspeaker 250 to generate anti-noise y'(n) in a noise cancellation zone 260. The noise cancelling headphone 210 will cancel the noise d(n) in the noise cancellation zone 260 when the anti-noise y'(n) is equal in magnitude and opposite in phase to the noise d(n) received in the noise cancellation zone 260. In one embodiment, the noise cancellation zone 260 represents a listener's ear or ear canal. In some embodiments, an explicit error microphone might not be present and pre-measured transfer functions are used to determine the appropriate computations carried out by the DSP 220.

The physical geometries and fit variations of the headphone 210 can affect noise cancellation performance. The frequency response of headphones can vary due to mechanical variations during the manufacturing of headphones. Further, headphones are typically manufactured from a one-size-fit-all perspective but person to person variation in the shape of pinna/outer ear can significantly alter the acoustic transfer functions of interest in an ANC application. The variations in microphone-speaker distance, person-to-person differences in the length of ear canal and other factors can influence the actual cancellation performance, and lead to undesired noise in the noise cancellation zone.

One approach to reduce the ANC performance variations induced by manufacturing tolerances is by measuring and correcting the performance variations, unit by unit in the production line via a calibration process. For example, to calibrate the active noise cancellation, an error microphone 262 may be provided in the cancellation zone 260. The error microphone 262 senses sound within the noise cancellation zone 260, which may be generated by the loudspeaker 250 and one or more noise sources external to the loudspeaker 250. The received error signal e(n) is the sum of the sensed noise d(n) and the sensed anti-noise y'(n). The error signal e(n) is fed through ADC 264 to the DSP 220. The DSP 220 adjusts the magnitude and phase of the cancellation signal to minimize the error signal e(n) within the cancellation zone 262, such that the error signal e(n) is driven to zero. In one embodiment, the loudspeaker 250 may also generate a desired signal which is removed from the error signal e(n) prior to generation of the anti-noise. This method, however, fails to account for the differences in the end-user's fit/ear-shape, which can alter the location of the cancellation zone needed to cancel noise for the end-user. Further, production line methods using an error microphone for calibration can significantly add to the overall cost of manufacturing and lead to expensive products.

The normalization problem may be solved using a variety of methods. In one approach, the error correcting internal microphone may be used in between the loudspeaker and the ear drum. In practice the error correcting microphone solution, such as illustrated in FIG. 2, is expensive due to the need for an extra microphone and additional processing circuitry. Another approach is to calibrate the equipment on the factory assembly line with a custom calibration sequence and equipment as described above. Yet another approach can be stipulating tighter tolerances on the transducer specifications or by reducing the fit variation via careful headphone design. These approaches eventually lead to higher production costs.

Figure 3:
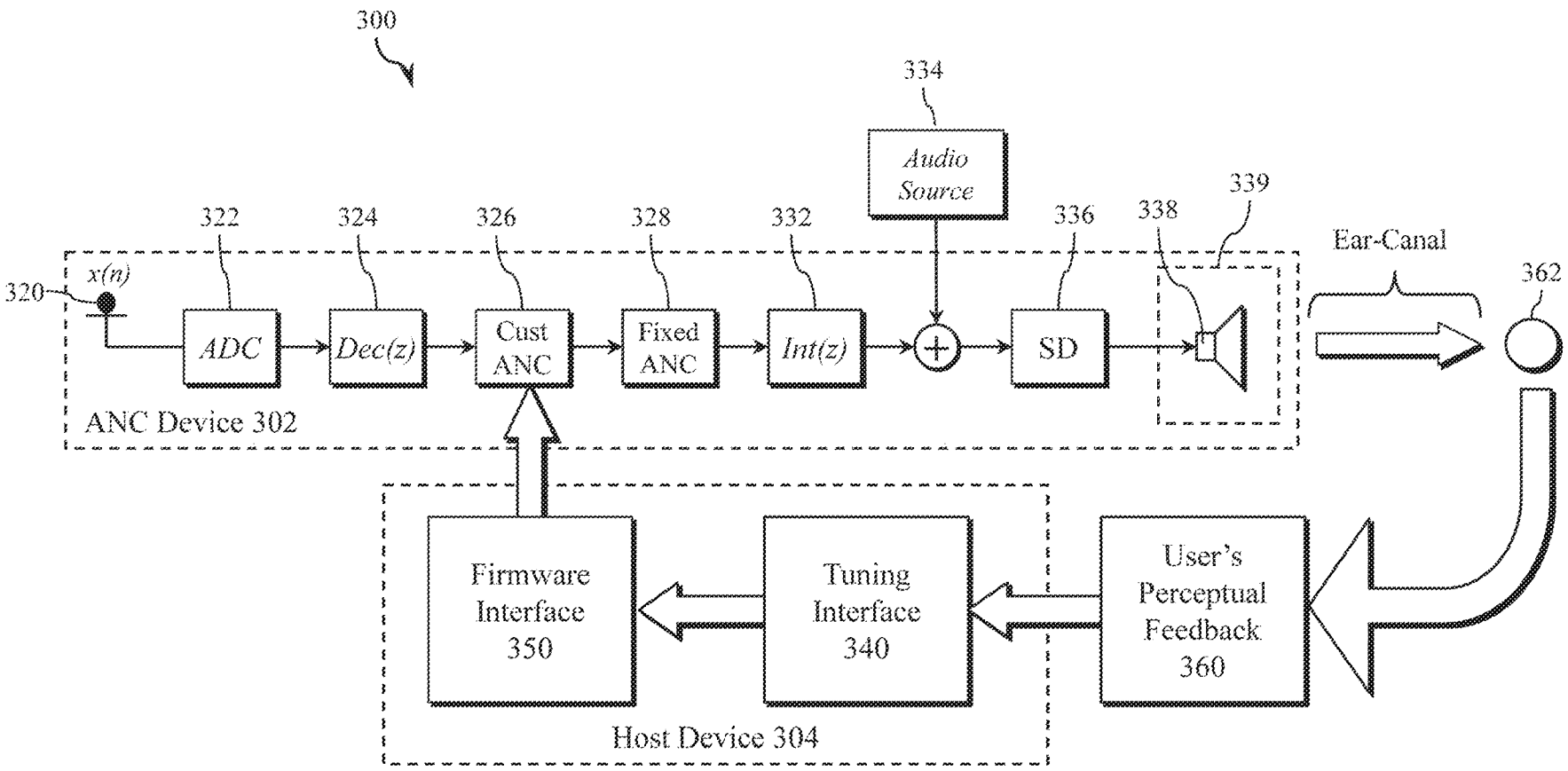
FIG. 3 illustrates an end-user tuning system for active noise cancelling headphones in accordance with an embodiment of the present invention.

Referring to FIG. 3, an embodiment of a calibration/normalization system and method will be described wherein normalization may be adjusted by an end-user. Calibration/Normalization approaches typically assume availability of a feedback signal that is indicative of the quality of cancellation. Usually the feedback sensor is a microphone that is mounted on an ear, head or torso simulator/equivalent equipment. The disclosed embodiment utilizes user feedback derived from the end-user's hearing by tuning the ANC filters such that the end-user hears the least ambient noise. It will be appreciated that the embodiments disclosed herein may be utilized with various ANC systems, including ANC systems that utility error microphones for feedback.

In one embodiment, the user turns on an audio device, such as ANC device 302, which is connected to a host device 304. In various embodiments, the ANC device may be implemented as a headphone, an in-ear headphone, an earbud, and other ANC implementations. The host device 304 may be, for example, a smart phone, a mobile device, an audio system, a personal computer, a laptop computer or other processing system. In some embodiments, the host device 304 and ANC device 302 are incorporated into a single unit. In one embodiment, the user can utilize a dedicated application 340 on the host device 304, which provides an intuitive way of changing certain parameters that are instantly reflected in the perceived amount of residual noise. The user may experiment with the intuitive controls and determine the optimum settings based on his/her perceptual feedback mechanism. The user can then freeze/save the optimum profile.

The ANC device 302 includes components for generating an anti-noise signal including a microphone 320 for sensing noise to be cancelled, an analog to digital converter (ADC) 322, a decimation filter 324, custom ANC circuitry 326, fixed ANC circuitry 328, and an interpolation filter 332. An audio source 334 provides desired audio signal to the ANC device 302, which is added to the anti-noise signal and amplified by a sigma-delta digital to analog converter 334 that drives a loudspeaker 339 in a listening device 339, such as a headset.

Figure 5:
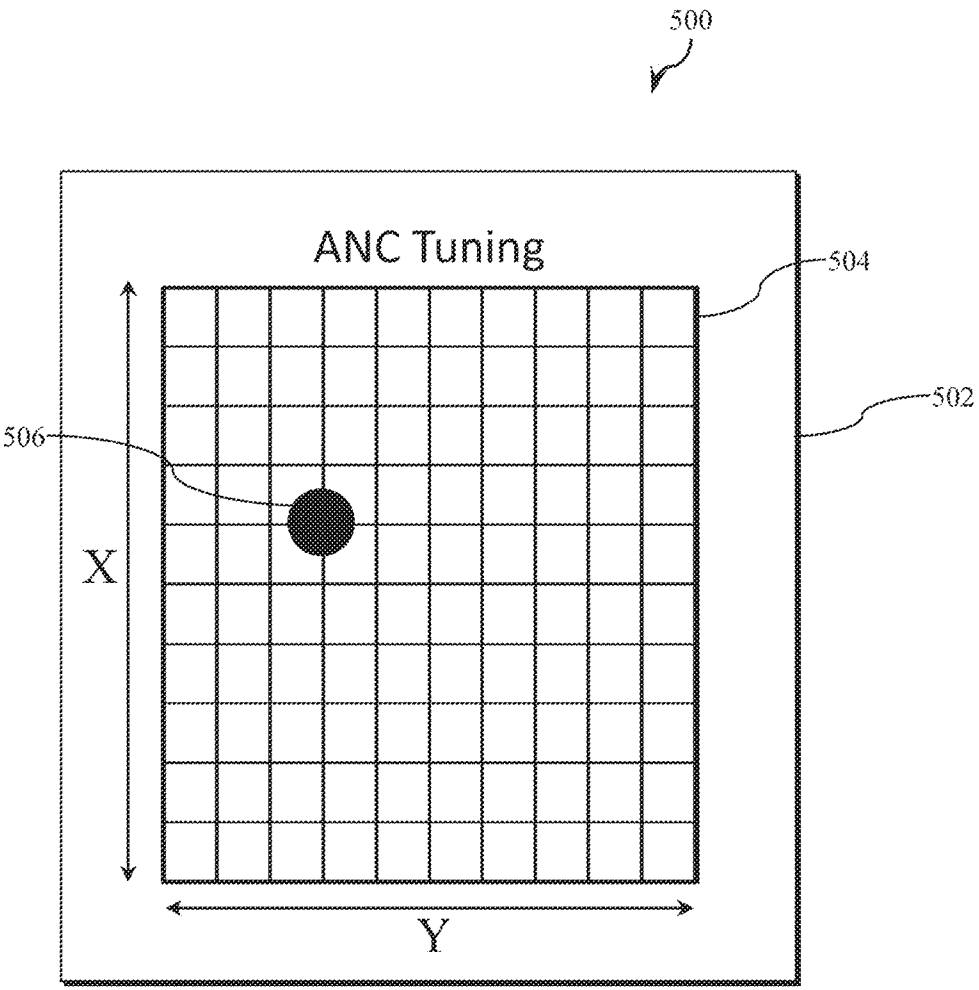
FIG. 5 is an exemplary user interface in accordance with an embodiment of the present invention.

In one embodiment, the fixed ANC circuitry 328 performs physical modeling and equalization of a conventional ANC filter. The fixed ANC circuitry 328 may be configured using parameters determined from a test environment, such as measurements from a prototype sample of the ANC device 302. The custom ANC circuitry 326 includes programmable parameters that may be configured via an external interface (such as illustrated in FIG. 5) allowing a user to fine-tune the overall response of the ANC path. In one embodiment, the custom ANC circuitry 326 is pre-programmed in production to normalized manufacturing variations. In an alternate embodiment, the order of the fixed ANC 328 and the custom ANC 326 can be switched. In another embodiment, a single tunable filter is provided in the audio processing chain that implements both the fixed and customizable parameters.

The tunable parameters of the custom ANC circuitry 326 are translated into intuitive controls that an end-user can adjust through a tuning interface 340. The adjusted controls are transmitted to a firmware interface 350 that maps the controls back to the tunable parameters of the custom ANC circuitry 326. When in a noisy environment the user can access the tuning interface 340, which may be implemented as a graphical user interface running on the host device 304, and using the user's perceptual feedback 360, determine the parameters that best fit the headset 339 and user's acoustics (e.g., ear canal and ear drum 362). In one embodiment, user preferences may be stored in a memory of the host device 304 for different listening environments and headphone users and selected based on a user identifier or selection through the tuning interface.

In one embodiment, the tunable parameters may represent a gain on the ANC path in each ear. By adjusting the gain of the anti-noise signal, a user can compensate for sensitivity variations in microphones and loudspeakers in the headset. In another embodiment, the tunable parameters may be used to alter the group delay response of the ANC filter path. By adjusting the phase of the anti-noise signal, the user can compensate for variations in the structure of the ANC device and the noise cancellation zone. The tunable parameters may also be used to adjust values in a headset model, allowing a new ANC filter to be calculated for the device. For example it can be expected that the seal between the ear and the headphone varies from person to person and may change over time. Users may also experience different levels of sound leakage based in their own physical features. For different levels of leakage a different ANC filter setting may be required to optimize performance. Using a headset model that predicts the ANC filter settings based on parameterization of physical quantiles like leakage can allow further customization of the ANC filter using user feedback. In various embodiments, some or all of the above parameters may be altered by the user.

Figure 4:
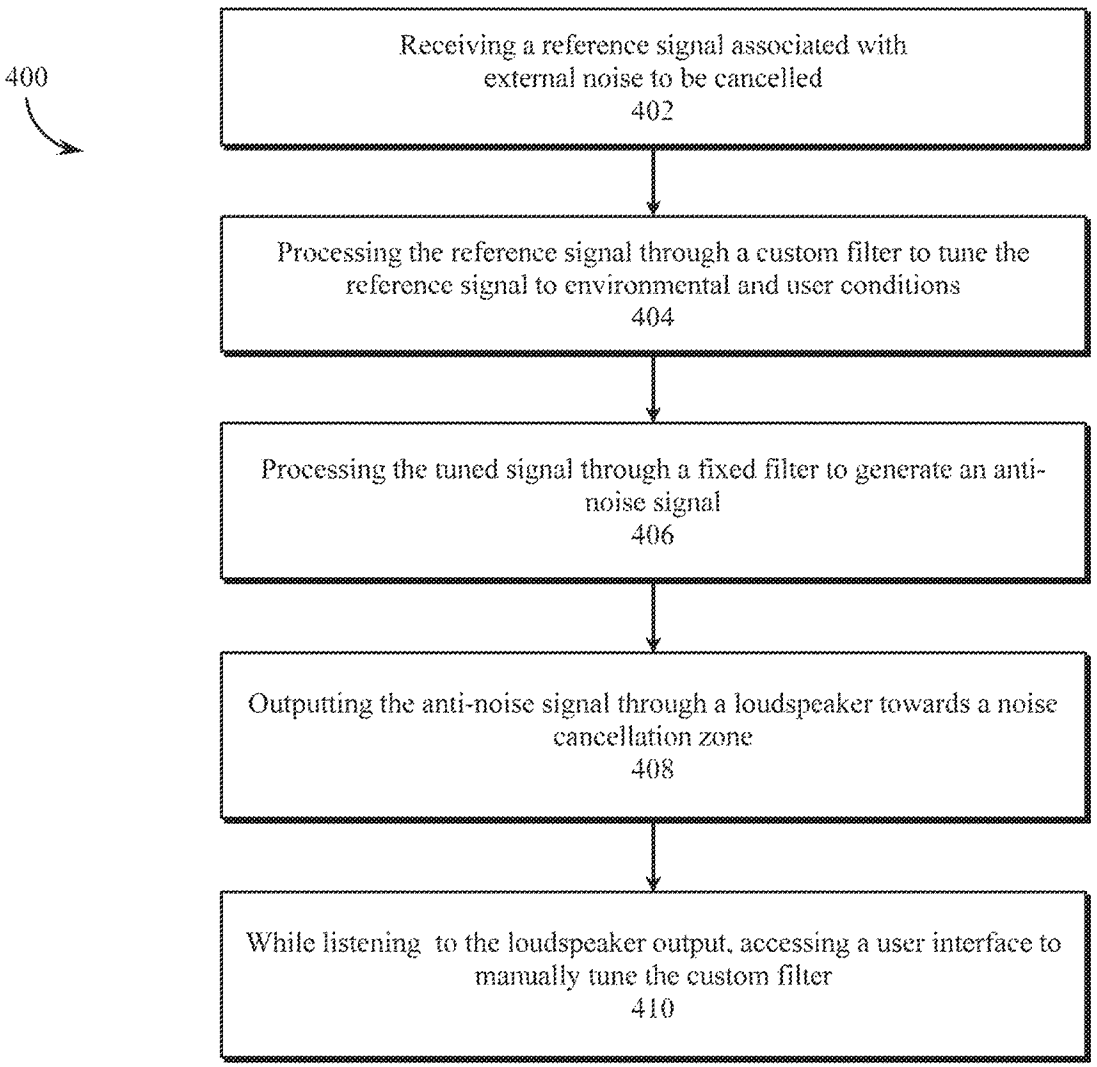
FIG. 4 is a flow chart illustrating an exemplary method for end-user tuning of active cancelling audio devices in accordance with an embodiment of the present invention.

Referring to FIG. 4, a method 400 for active noise cancellation will now be described. In step 402, the active noise cancellation system receives a reference signal associated with external noise to be cancelled. As described above, the reference signal may be received through an external microphone. The reference signal is processed through a custom filter to tune the reference signal to environmental and user conditions in step 404. Next, in step 406, the tuned signal is processed through a fixed filter to generate an anti-noise signal having the substantially the same magnitude and opposite phase as the external noise received in a noise cancellation zone. In various embodiments, steps 404 and 406 may be performed in a different order or combined into a single step. In step 408, the anti-noise signal is output through a loudspeaker towards a noise cancellation zone, such as a listener's ear. In step 410, while listening to the loudspeaker output, a user accesses a user interface to manually tune the custom filter, allowing the user to optimize the noise cancellation for the current environmental and user conditions. In one embodiment, the user controls allow adjustment of the gain and phase of the anti-noise signal.

FIG. 5 illustrates an exemplary user interface in accordance with an embodiment of the present invention. As illustrated, user interface 500 includes a display screen 502 displaying a graphical user interface, such as grid 504 on a touch screen device. In one embodiment, the grid 504 is a two-dimensional grid with each dimension (X,Y) representing a coefficient value for tuning the noise cancellation. In operation, a user actively listening through the noise cancelling audio device may contact the screen and drag the dot 504 to change the parameters (X,Y) while actively listening to and reacting to the perceived noise levels. In alternate embodiments, the user interface may be implemented using one-dimensional controls (similar to EQ tuning) or 2D sliders, with each slider adjusting one or more coefficients. Further, in various embodiments, the dot may be manipulated through other available system input devices such as a mouse or keyboard.

As illustrated, each position of the dot 506 corresponds to a new pair of parameters that will be translated into ANC settings. The pair could be two coefficients that are applied to ANC settings in the same ear or be one coefficient for each ear. In various embodiments, the GUI can be extended to include more than one point that can be moved independently, with each point corresponding to new coefficient pair, thus giving more degrees of freedom in custom tuning. In one embodiment, the pair of parameters represents gain and phase parameters, respectively.

Figure 6:
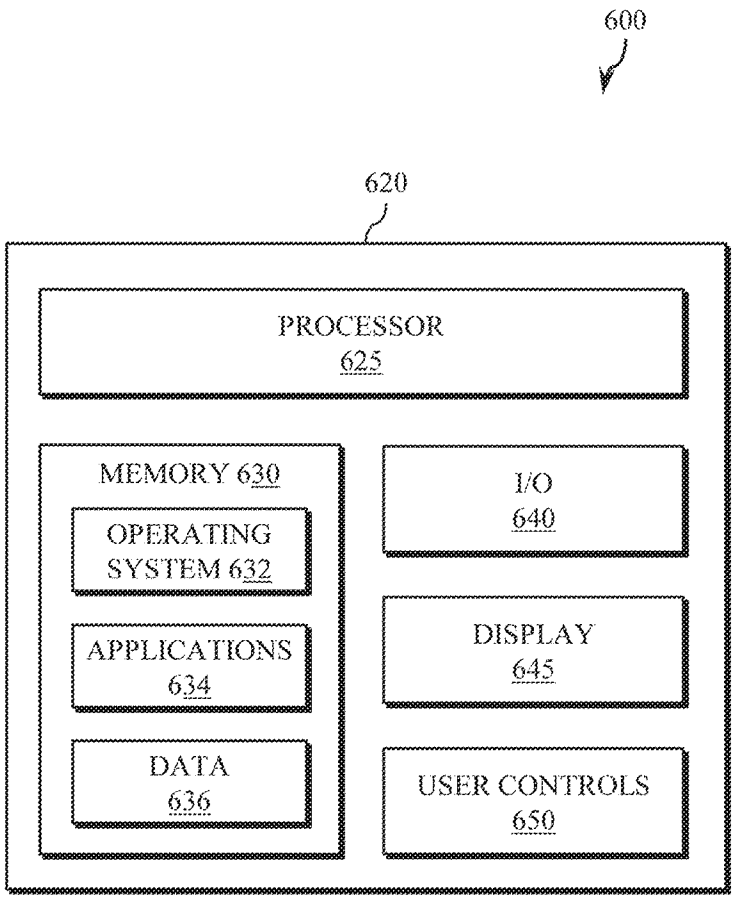
FIG. 6 is a block diagram of an exemplary hardware system in accordance with an embodiment of the disclosure.

As discussed, the various techniques provided herein may be implemented by one or more systems which may include, in some embodiments, one or more subsystems and related components thereof. For example, FIG. 6 illustrates a block diagram of an example hardware system 600 in accordance with an embodiment of the disclosure. In this regard, system 600 may be used to implement any desired combination of the various blocks, processing, and operations described herein, including implementing one or more blocks of the host device 304 and ANC device 302 of FIG. 3. Although a variety of components are illustrated in FIG. 6, components may be added and/or omitted for different types of devices as appropriate in various embodiments.

As shown, system 600 includes input/output 640 which may include, for example, audio input/out interface for connecting the system 600 to a headset. The system 600 includes a processor 625, a memory 630, a display 645, and user controls 650. Processor 625 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), codecs, and/or other processing devices.

In some embodiments, processor 625 may execute machine readable instructions (e.g., software, firmware, or other instructions) stored in memory 630. In this regard, processor 625 may perform any of the various operations, processes, and techniques described herein. In other embodiments, processor 625 may be replaced and/or supplemented with dedicated hardware components to perform any desired combination of the various techniques described herein.

Memory 630 may be implemented as a machine readable medium storing various machine readable instructions and data. For example, in some embodiments, memory 630 may store an operating system 632 and one or more applications 634 as machine readable instructions that may be read and executed by processor 625 to perform the various techniques described herein. Memory 630 may also store data 636 used by operating system 632 and/or applications 634. In some embodiments, memory 620 may be implemented as non-volatile memory (e.g., flash memory, hard drive, solid state drive, or other non-transitory machine readable mediums), volatile memory, or combinations thereof.

Display 645 presents information to the user of system 600. In various embodiments, display 645 may be implemented as a liquid crystal display (LCD), an organic light emitting diode (OLED) display, and/or any other appropriate display. User controls 650 receive user input to operate system 600 (e.g., to adjust parameters as discussed). In various embodiments, user controls 650 may be implemented as one or more physical buttons, keyboards, levers, joysticks, and/or other controls. In some embodiments, user controls 650 may be integrated with display 645 as a touchscreen.

In various embodiments, system 620 may be used to provide active user tuning of an acoustic noise cancellation device, such as a set of headphones connected to the system 620 through I/O 640. In such embodiments, processor 625 may run an application stored in memory 634 providing a graphical user interface displayed on display 645 and controlled by user controls 650 for adjusting parameters of the acoustic noise cancellation device.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. An active noise cancellation system comprising:

a reference sensor configured to sense external noise and generate a corresponding reference signal;

a plurality of noise cancellation filters comprising a user-tunable noise cancellation filter and a fixed noise cancellation filter configured to receive the reference signal and generate a corresponding user-tuned anti-noise signal in accordance with stored parameters comprising at least one user-tunable parameter;

a loudspeaker configured to generate anti-noise output corresponding to the user-tuned anti-noise signal to suppress the external noise present in a noise cancellation zone associated with the user's ear canal; and a user interface configured to receive user input in response to the generated anti-noise output, the user input comprising user-controlled adjustments to the at least one user-tunable parameter, wherein the user-tuned anti-noise signal is modified in real-time by adjustments to the user-tunable noise cancellation filter in response to the user-controlled adjustments of the at least one user-tunable parameter to adjust one or more properties of the anti-noise output in the noise cancellation zone to calibrate the active noise cancellation system for the user.

2. The active noise cancellation system of claim 1, wherein the user-tunable noise cancellation filter is configured to modify the user-tuned anti-noise signal in response to the user-controlled adjustments to the user-tunable parameter.

3. The active noise cancellation system of claim 2, wherein the fixed noise cancellation filter comprises a predetermined model of the active noise cancellation system; and wherein the user-tunable noise cancellation filter is configured to model tunable deviations from the predetermined model of the active noise cancellation system.

4. The active noise cancellation system of claim 2, further comprising a host device comprising:

the user interface to facilitate user adjustment of the user-tunable parameter; and a digital signal processor comprising the plurality of noise cancellation filters.

5. The active noise cancellation system of claim 1, wherein the user interface facilitates adjustment of the at least one tunable parameter in response to user feedback of perceived residual noise in the noise cancellation zone.

6. The active noise cancellation system of claim 5, further comprising an error microphone configured to sense the residual noise in the noise cancellation zone; and wherein the plurality of filters further comprises processing components configured to adjust stored parameters to reduce the sensed residual noise.

7. The active noise cancellation system of claim 1, wherein the user interface comprises a graphical user interface configured to display a two-dimensional grid and receive user input comprising a location on the two-dimensional grid representing values for a pair of user-tunable parameters.

8. The active noise cancellation system of claim 1, wherein the user interface is configured to display a control graphic and adjust a position of the control graphic in response to user input; and wherein the user interface is configured to translate changes in the position of the control graphic into a real-time adjustment of the at least one user-tunable parameter to tune the generated anti-noise.

9. The active noise cancellation system of claim 1, wherein the at least one user-tunable parameter represents a gain and/or a phase delay of the anti-noise signal; and wherein the user can compensate for variations in the sensor, loudspeaker, physical properties of the active noise cancellation system, and/or physical properties of the user by adjusting the gain through the user interface.

10. The active noise cancellation system of claim 1, further comprising an audio signal input configured to receive an audio signal from an audio source; and an adder configured to combine the audio signal with the user-tuned anti-noise signal for input to the loudspeaker to generate audio output corresponding to the audio signal and the anti-noise.

11. The active noise cancellation system of claim 1, wherein the active noise cancellation system is a headphone, wherein performance of the active noise cancellation system depends, at least in part, on a position of the headphone with respect to a user's ear and/or ear canal; and wherein the user interface facilitates adjustment of the at least one tunable parameter in real-time to adjust for variations in a fit of the headphone to the user's ear and/or ear canal.

12. A method for active noise cancellation comprising:

sensing external noise, using a reference sensor, and generating a corresponding reference signal;

producing, using a plurality of noise cancellation filters comprising a user-tunable noise cancellation filter and a fixed noise cancellation filter, a user-tuned anti-noise signal corresponding to the reference signal to cancel the sensed external noise in accordance with stored parameters comprising at least one user-tunable parameter;

generating, using a loudspeaker, user-tuned anti-noise output corresponding to the user-tuned anti-noise signal to suppress the external noise present in a noise cancellation zone associated with the user's ear canal;

receiving, using a user interface, user input in response to the generated anti-noise output; and updating the user-tunable parameter in real-time in response to user-controlled adjustments to the at least one user-tunable parameter received through the user interface to adjust one or more properties of the user-tuned anti-noise output in the noise cancellation zone to calibrate the user-tunable noise cancellation filter of the active noise cancellation system for the user.

13. The method of claim 12, further comprising modifying the user-tuned anti-noise signal in response to the user-controlled adjustments to the user-tunable parameter.

14. The method of claim 12, wherein producing, using the plurality of noise cancellation filters, the user-tuned anti-noise signal further comprises filtering the reference signal using a predetermined model of an active noise cancellation system to generate the user-tuned anti-noise signal; and applying modifications to the at least one user-tunable parameter to generate user-tunable deviations from the predetermined model of the active noise cancellation system.

15. The method of claim 12, wherein the loudspeaker is configured to generate the anti-noise output to cancel the sensed external noise in a cancellation zone comprising a user's ear and/or ear canal; and wherein the user interface facilitates adjustment of the at least one tunable parameter in real-time in response to user feedback of perceived residual noise the cancellation zone.

16. The method of claim 15, further comprising sensing the residual noise in the cancellation zone using an error microphone; and adjusting parameters of the plurality of filters to reduce the residual noise sensed from the error microphone.

17. The method of claim 12, wherein updating the user-tunable parameter in response to real-time, user-controlled adjustments to the at least one user-tunable parameter received through a user interface, further comprises:

displaying a two-dimensional grid and detecting user input comprising a location on the two-dimensional grid; and tuning the anti-noise signal in response to a pair of user-tunable parameters corresponding to location on the two-dimensional grid.

18. The method of claim 12, wherein updating the user-tunable parameter in response to real-time, user-controlled adjustments to the at least one user-tunable parameter received through a user interface, further comprises:

displaying a control graphic and adjusting a position of the control graphic in response to user input; and translating changes in the position of the control graphic into a real-time adjustment of the at least one user-tunable parameter to tune the generated anti-noise.

19. The method of claim 12, wherein the at least one user-tunable parameter represents a gain and/or phase delay of the anti-noise signal.

20. The method of claim 12, further comprising receiving an audio signal from an audio source;

adding the audio signal to the user-tuned anti-noise signal;

generating, using the loudspeaker, corresponding audio output listening by the user and the anti-noise to cancel the sensed external noise.

* * * * *